US010898047B2

(12) United States Patent
Goff

(10) Patent No.: US 10,898,047 B2
(45) Date of Patent: Jan. 26, 2021

(54) FLUID COLLECTION SYSTEM FOR FLOOR MAINTENANCE MACHINE

(71) Applicant: RPS CORPORATION, Racine, WI (US)

(72) Inventor: Sean K Goff, Breckenridge, CO (US)

(73) Assignee: RPS Corporation, Racine, WI (US)

( * ) Notice: Subject to any disclaimer, the term of this patent is extended or adjusted under 35 U.S.C. 154(b) by 942 days.

(21) Appl. No.: 15/146,997

(22) Filed: May 5, 2016

(65) Prior Publication Data

US 2016/0331201 A1 Nov. 17, 2016

Related U.S. Application Data

(60) Provisional application No. 62/159,537, filed on May 11, 2015.

(51) Int. Cl.
*A47L 11/40* (2006.01)
*A47L 11/292* (2006.01)

(52) U.S. Cl.
CPC ..... *A47L 11/4077* (2013.01); *A47L 11/292* (2013.01); *A47L 11/4016* (2013.01)

(58) Field of Classification Search
CPC ..... A47L 11/4077; A47L 11/4016; A47L 7/0023; A47L 11/4019; A47L 11/02; A47L 11/29; A47L 11/30; A47L 11/302; A47L 11/305; A47L 11/307; A47L 11/40; A47L 11/4027; A47L 11/4036
USPC ..... 15/320
See application file for complete search history.

(56) References Cited

U.S. PATENT DOCUMENTS

| | | | | |
|---|---|---|---|---|
| 4,893,375 | A * | 1/1990 | Girman | A47L 11/30 15/320 |
| 7,073,226 | B1 * | 7/2006 | Lenkiewicz | A47L 11/34 15/320 |
| 7,225,503 | B1 * | 6/2007 | Lenkiewicz | A47L 5/24 15/320 |
| 7,945,989 | B2 * | 5/2011 | Sepke | A47L 9/0483 137/87.01 |
| 2002/0108209 | A1 * | 8/2002 | Peterson | A47L 7/0009 15/353 |
| 2004/0088817 | A1 * | 5/2004 | Cochran | A47L 5/14 15/327.5 |
| 2007/0169305 | A1 * | 7/2007 | Shea | E01H 1/103 15/320 |
| 2007/0209334 | A1 * | 9/2007 | Conrad | A47L 5/28 55/337 |
| 2009/0078290 | A1 * | 3/2009 | Addicks | A47L 11/305 134/21 |

(Continued)

*Primary Examiner* — Bryan R Muller
*Assistant Examiner* — Aaron R McConnell
(74) *Attorney, Agent, or Firm* — Quarles & Brady LLP

(57) ABSTRACT

A fluid collection system for a floor maintenance machine provides improved collection of fluid, foam, and debris prior to the vacuum source. The fluid collection system includes a recovery chamber defining a volume, a hollow structure (such as a modified skirt) having an internal chamber, and a vacuum source in fluid communication with the volume of the recovery chamber via the internal chamber and a vacuum line. The vacuum source draws a vacuum in the volume of the recovery chamber by drawing a gas from the volume of the recovery chamber through the internal chamber of the hollow structure and through the vacuum line.

16 Claims, 7 Drawing Sheets

(56) References Cited

U.S. PATENT DOCUMENTS

| | | | | |
|---|---|---|---|---|
| 2016/0198917 | A1* | 7/2016 | Bensing | A47L 9/0081 15/326 |
| 2016/0278598 | A1* | 9/2016 | Werner | A47L 11/2025 |
| 2016/0296090 | A1* | 10/2016 | Scott | A47L 11/24 |
| 2017/0319032 | A1* | 11/2017 | Conrad | A47L 7/0038 |

* cited by examiner

FLUID COLLECTION SYSTEM FOR FLOOR MAINTENANCE MACHINE

CROSS-REFERENCE TO RELATED APPLICATION

This application claims the benefit of U.S. provisional patent application No. 62/159,537 filed May 11, 2015 which is hereby incorporated by reference for all purposes as if set forth in its entirety herein.

STATEMENT OF FEDERALLY SPONSORED RESEARCH OR DEVELOPMENT

Not applicable.

BACKGROUND

This invention relates to equipment for floor maintenance machines and, in particular, to fluid collection systems for floor maintenance machines.

Floor maintenance machines or scrubbers provide a way to clean dirty floor surfaces. Typically, an operator directs a floor maintenance machine over the surface to be cleaned by steering or guiding the floor maintenance machine. With the help of a supplied cleaning fluid, an oscillating pad or rotating brushes of the floor maintenance machine can directly contact the floor surface to loosen debris that is on the surface of the floor.

During cleaning, this debris, fluid, and foam mixture is lifted from the floor into a recovery chamber using a fluid collection system. This fluid collection system typically includes a vacuum source that is connected to an interior volume of the recovery chamber via one line and another separate line that extends from the interior volume of the recovery chamber to an opening that is positioned near a collection squeegee on the floor. When the vacuum source is run during floor cleaning, the vacuum source draws gas, fluid, foam, and/or debris up into the recovery chamber from the opening of the line near the collection squeegee (and further draws gas from the recovery chamber to the vacuum source via the line connecting the chamber and the vacuum source). To maintain a robust vacuum and to prevent the ingress of liquid, foam, or debris into the vacuum source, the ends of the lines are typically elevated within the recovery chamber so they remain above the liquid level of the recovery chamber.

A significant amount of foam can accumulate on the top of the recovered liquid in the recovery chamber after is it is collected from the floor. To prevent this foam from being sucked into the vacuum source, the collection chamber typically includes a baffle to bifurcate the chamber into two sides including one "foamy" side having the inlet for the line introducing the collected liquid, foam, and debris into the chamber and another "non-foamy" side having the intake for the line connected to the vacuum. While inhibiting transfer of foam from one side to the other, this baffle still permits liquid to migrate from one side to the other so the entire volume of the recovery chamber can potentially be used to store the used fluid.

Nonetheless, despite this baffle, in some instances, foam or floating debris may pass to the side of the baffle with the intake for the line to the vacuum. When this happens, despite the precautions in place of the baffle and a filtration screen on the end of the intake for the line drawing the vacuum, there is an increased likelihood that such debris or foam could be pulled into the line drawing the vacuum in the recovery chamber and/or that the protective screen may be clogged on the intake of the line through which the vacuum is drawn. When such debris or foam is able to enter the vacuum source, it can have a severe negative effect on the vacuum that is drawn and potentially even damage the vacuum source. Apart from damage to the floor cleaning machine itself, if the fluid collection system is compromised, then the fluid that is dispensed on the floor for cleaning may not be full sucked up and portions of the floor may remain wet and dirty cleaning fluid with debris can remain on the floor.

Further, in some instances, there may also be an additional filter just prior to the vacuum pump that prevents the ingress of contaminants that have made it that far up the line toward the vacuum source. However, in most such instances, this filter is disposed within the machine and, unless an operator looks to see whether the filter needs replacing, this filter may remain out of sight and mind and not be replaced on a sufficiently consistent basis.

Thus, there is a need for improved fluid collection systems and, in particular, for fluid collection systems which prevent debris and foam from entering the vacuum source.

SUMMARY OF THE INVENTION

To improve the fluid collection system of a floor cleaning machine, various improvements are proposed herein. Among other things, features of the floor maintenance machine that are already in existence and serve other functions can now be modified in such a way that they are added to the gas pathway for drawing the vacuum. One or more components that are traditionally non-hollow or are traditionally not part of a vacuum pathway such as a skirt (which may also be referred to as a bandeau) are discussed herein that may be made hollow in their interior to define extended segments of the pathway through which gas is drawn. Further, the hollow component can be outfitted with non-conventional features (for example, internal ribs or a fluid release valve at a low point in the skirt) that further assist in preventing debris, foam, and/or liquid from passing all the way to the vacuum source or that permits the debris, foam, and/or liquid to be removed along the pathway before it reaches the vacuum source.

According to one aspect of the invention, a fluid collection system is provided for a floor maintenance machine. The fluid collection system includes a recovery chamber defining a volume. When in use, this recovery chamber is typically configured to receive recovered fluid that has been used to clean the floor and associated foam and debris. The fluid collection system further includes a hollow structure (in many instances a modified skirt) having an internal chamber and a vacuum source in fluid communication with the volume of the recovery chamber via the internal chamber and a vacuum line. The vacuum source is able to draw a vacuum in the volume of the recovery chamber by drawing a gas from the volume of the recovery chamber through the internal chamber of the hollow structure and through the vacuum line.

In one particular form, the hollow structure may be a skirt of the floor maintenance machine in which the skirt is configured to surround the floor cleaning implements of the floor maintenance machine.

In the case of the hollow structure being a skirt, in some forms, the vacuum source may draw a vacuum in the volume of the recovery chamber by drawing the gas from the recovery chamber sequentially through an intake of a hollow filter box, through the vacuum line, and through the internal chamber of the skirt to the vacuum source.

Further in the case of the hollow structure being a skirt, the skirt may have a side wall that extends downwardly to a low point at which the skirt has a valve selectively placing the internal chamber of the skirt in fluid communication with a surrounding environment. When the interior chamber of the skirt is below a threshold pressure, the valve may be held closed and, when the threshold pressure is exceeded, the valve may be permitted to open to accommodate the release of any liquid that has collected in the interior chamber of the skirt from the interior chamber of the skirt. This valve may be, for example, a duck bill valve.

In some forms, the skirt may have a horizontal platform and a side wall extending downwardly from the horizontal platform. A skirt connection port connected to the vacuum line and an intake port connected to the vacuum pump may be supported and positioned on the skirt and more particularly, a top wall of the horizontal platform. In some forms, a rib may be formed in the horizontal platform that separates the skirt connection port from the intake port. A presence of the rib on the horizontal platform may require any fluid drawn from the skirt connection port to the intake port to flow from the horizontal platform and into the side walls of the skirt. As mentioned above, in this location any liquid, foam, or debris might be able to collect at a low point for unloading from the interior chamber via a valve. In some forms, the skirt may include a rear wall extending upwardly from the horizontal platform. The rear wall may define one surface of a volume in which the vacuum source is received to contain or dampen a noise emitted from the vacuum source. Additionally or alternatively, the rear wall may be hollow and may provide a pathway from an exhaust port of the vacuum source to an opening at the rear wall to direct exhaust away from other operational components.

In some forms, the fluid collection system may further include a hollow filter box. The hollow filter box may provide an upper intake having a floating ball valve mechanism received therein. The floating ball valve mechanism may include a vertically-extending column with a ball received therein which is movable vertically therein. The ball may be configured to float on a liquid received and stored in the recovery chamber to ascend the vertically-extending column such that, when the ball is raised within the column, the ball seals the upper intake to inhibit passage of the liquid from the recovery chamber into the hollow structure. In some cases, the hollow filter box may further receive a filter that is interposed between the volume of the recovery chamber and an upper intake of the box. It is contemplated that a cover on the hollow filter box may be transparent such that the filter is viewable from a top side.

In some forms, the fluid collection system may further include an intake hose including an opening that places the intake hose in fluid communication with the volume of the recovery chamber. This intake hose may be configured to draw used fluid from the floor into the recovery chamber when the vacuum is drawn in the recovery chamber.

According to another aspect of the invention, a floor maintenance machine may include the fluid collection system described herein and above (including the various workable permutations of features thereof described herein).

According to another aspect of the invention, a skirt for a floor maintenance machine is provided. The skirt includes a body having a hollow construction defining an internal chamber of the skirt. The body includes a lower wall that extends downwardly to a low point. A valve is disposed at the low point of the skirt in which the valve selectively places the internal chamber of the skirt in fluid communication with a surrounding environment.

In some forms, when the interior chamber of the skirt is below a threshold pressure, the valve may be held closed and, when the threshold pressure met, the valve may be permitted to open to accommodate the release of any liquid that has collected in the interior chamber skirt from the interior chamber of the skirt. This valve may be a duck bill valve.

In some forms, the skirt may include a horizontal platform and side walls extending downward about a portion of the periphery of the horizontal platform. Relative to the horizontal direction, a lower wall of the horizontal platform may have a first draft and a lower edge of the side wall may have a second draft extending to the low point.

In some forms, the skirt may further include an intake port configured to be connected to a vacuum source and a skirt connection port configured to be connected to a vacuum line. Both of these ports may be disposed on an upper wall of the horizontal platform of the skirt and a rib in the horizontal platform may be present that separates the intake port from the skirt connection port such that any fluid from the skirt connection port to the intake port is directed, at least temporarily, into a hollow section of the side walls for potential redirection to the low point, before the fluid can be received at the intake port.

These and still other advantages of the invention will be apparent from the detailed description and drawings. What follows is merely a description of some preferred embodiments of the present invention. To assess the full scope of the invention, the claims should be looked to as these preferred embodiments are not intended to be the only embodiments within the scope of the claims.

DETAILED DESCRIPTION OF THE PREFERRED EMBODIMENTS

Figure 1:
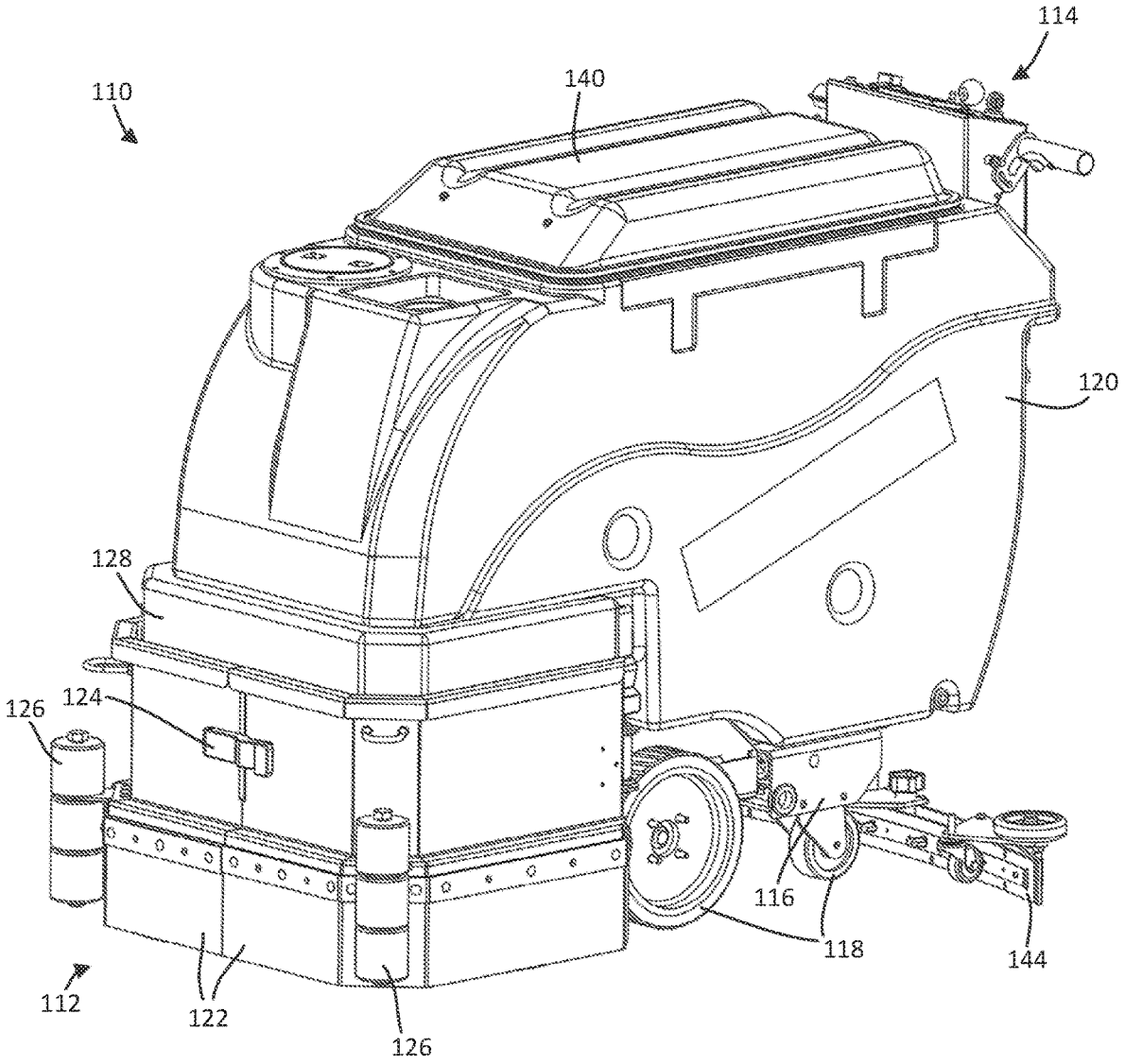
FIG. 1 is a top front left perspective view of a walk-behind floor maintenance machine having an improved fluid collection system.
Figure 2:
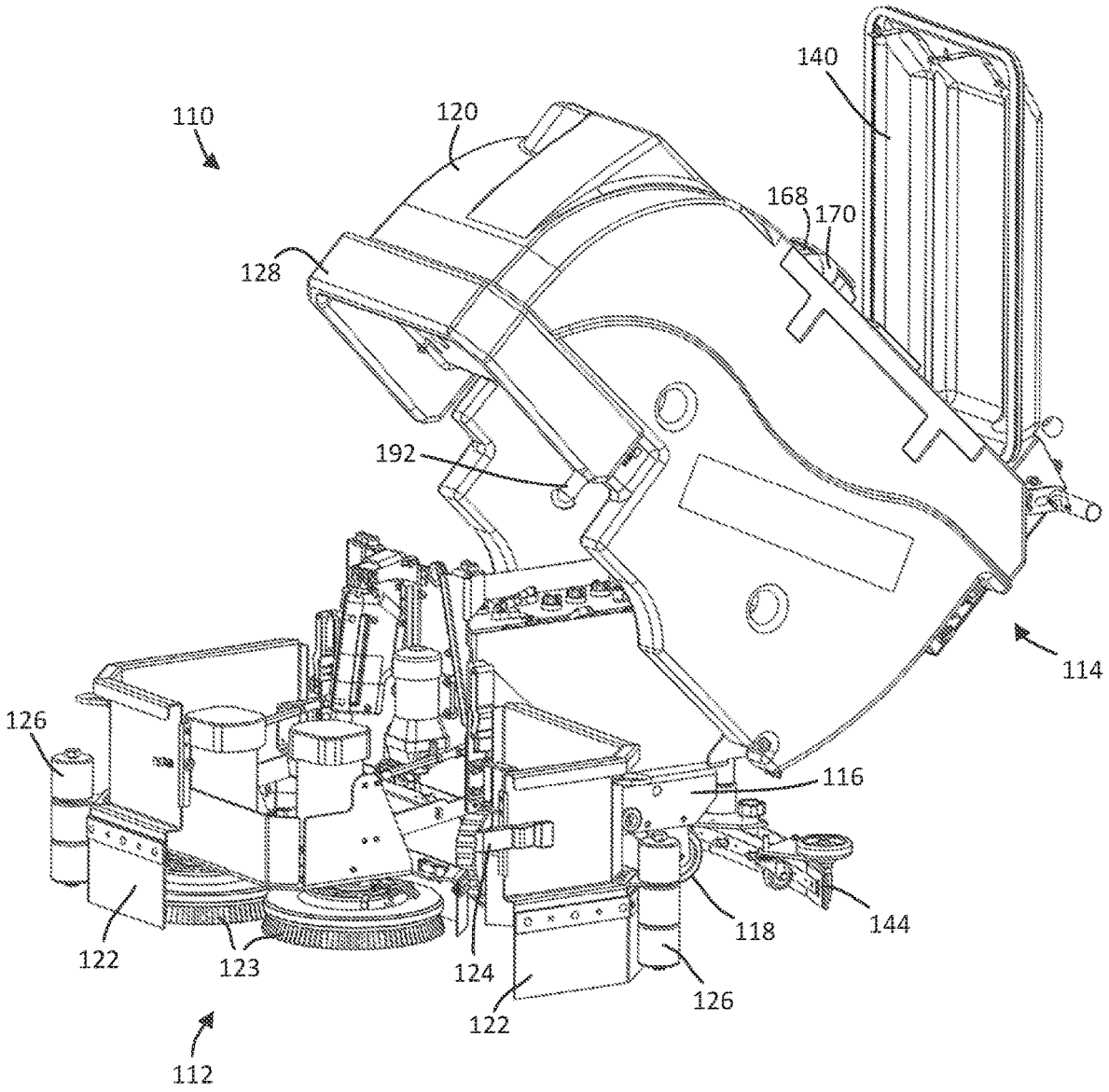
FIG. 2 is a top front left perspective view of the floor maintenance machine of FIG. 1, in which the liftable tank is illustrated in a lifted position, in which the cover is lifted, and in which the lower left jaw or panel is swung outward to reveal the floor cleaning implements.

Referring first to FIGS. 1 and 2, an exemplary floor cleaning machine is shown for the cleaning of floors. The floor scrubber 110 is a walk-behind floor scrubber, such as the Magnum manufactured by R.P.S. Corporation of Racine, Wis. However, the floor scrubber 110 could potentially be any kind of floor scrubber 110 including both walk-behind or riding-type floor scrubbers.

In the form shown, the floor scrubber 110 has a front end 112 and a rear end 114 behind which an operator may stand. A chassis 116 extends between the front end 112 and the rear end 114. The chassis 116 has a set of wheels 118 mounted on the bottom side thereof for contact with the floor. The body of the chassis 116 is largely covered by a liftable tank 120. The liftable tank 120 covers a number of the internal components of the floor scrubber 110 (e.g., the battery), many of which can be made accessible by lifting the tank 120 as depicted in FIG. 2.

With reference now to both FIGS. 1 and 2, at the front end 112 of the floor scrubber 110 and near the bottom of the liftable tank 120, a pair of jaws or access panels 122 partially surrounds a pair of motor-driven rotary brushes 123 or other cleaning implements (e.g., oscillating pads) for scrubbing or otherwise cleaning the floor. The pair of access panels 122 can hingedly swing outward, as illustrated in FIG. 2 in which only the left panel is hinged outward, to expose the rotary brushes 123 or other cleaning implement for maintenance, repair, or replacement. As illustrated in FIG. 1, the pair of access panels 122 are held closed by a latch 124 and each include a set of bumpers 126 that prevent damage should the floor scrubber 110 bump into a stationary object.

Figure 3:
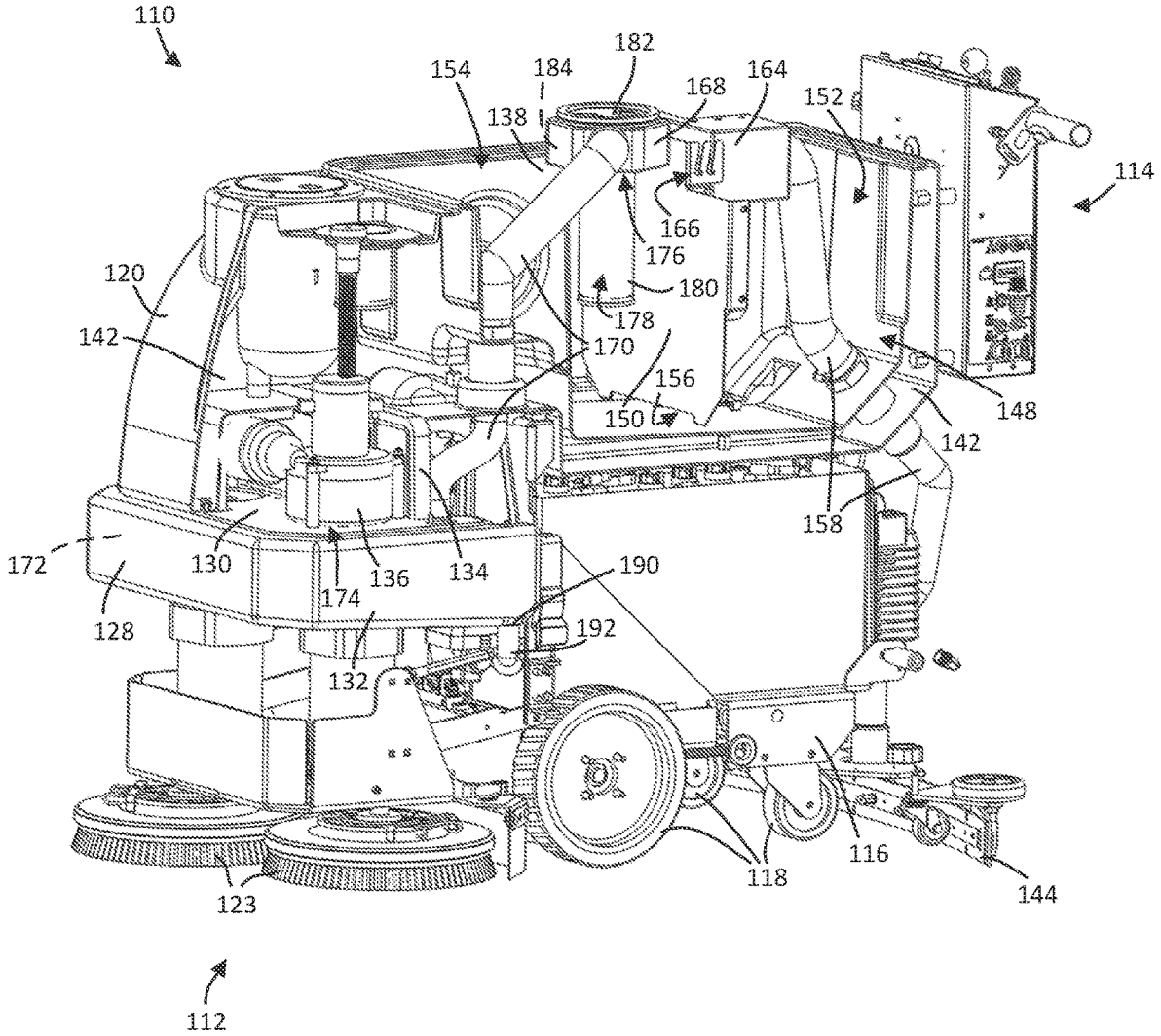
FIG. 3 is a partial cut away view of the floor maintenance machine of FIG. 1 with a section of the liftable tank removed to better illustrate the improved fluid collection system and without the panels covering the floor cleaning implements.
Figure 4A:
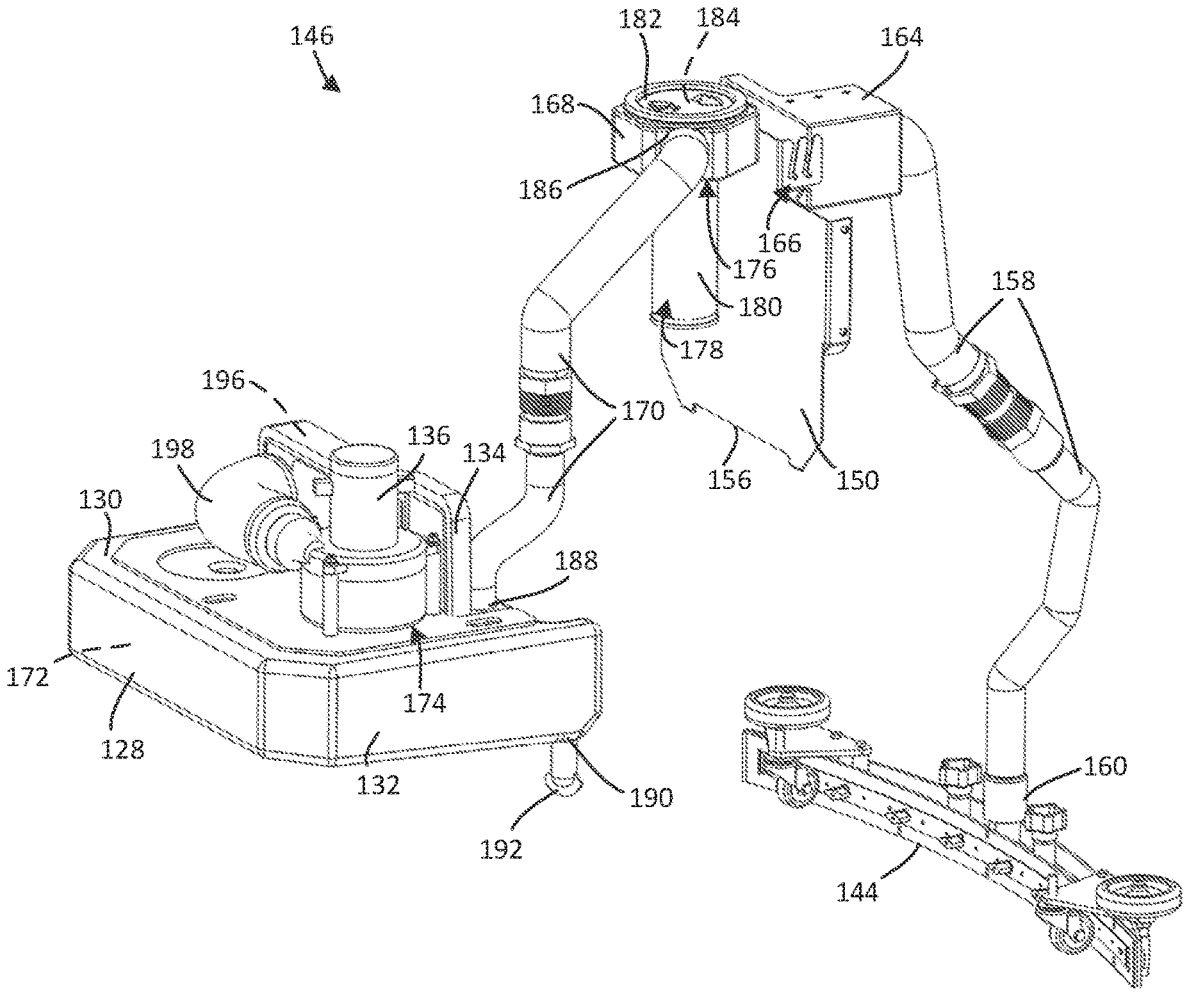
FIGS. 4A through 4D are various perspective views of the improved fluid collection system (without illustrating the recovery chamber of the liftable tank, best illustrated by FIG. 3).
Figure 4B:
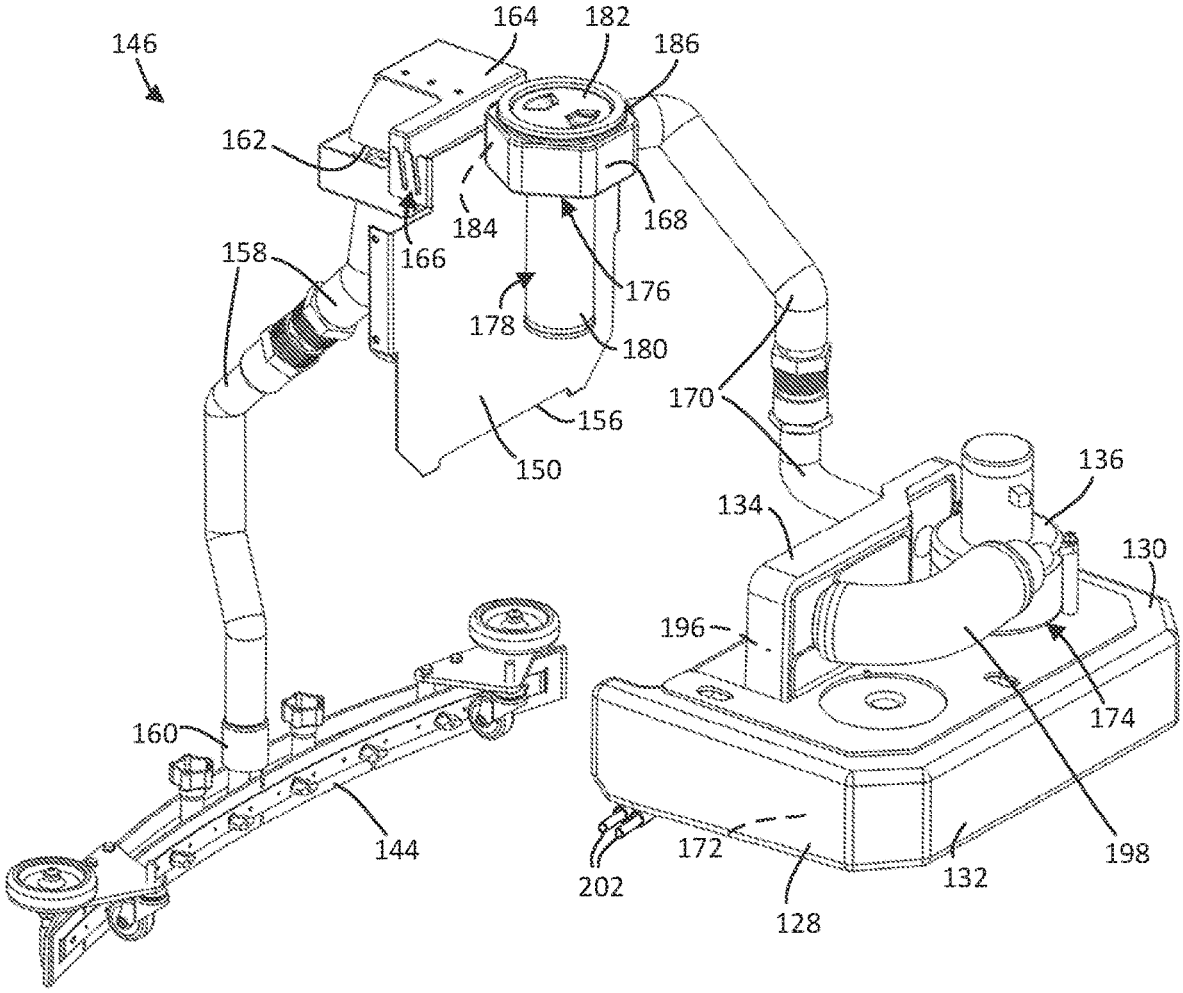
Figure 4C:
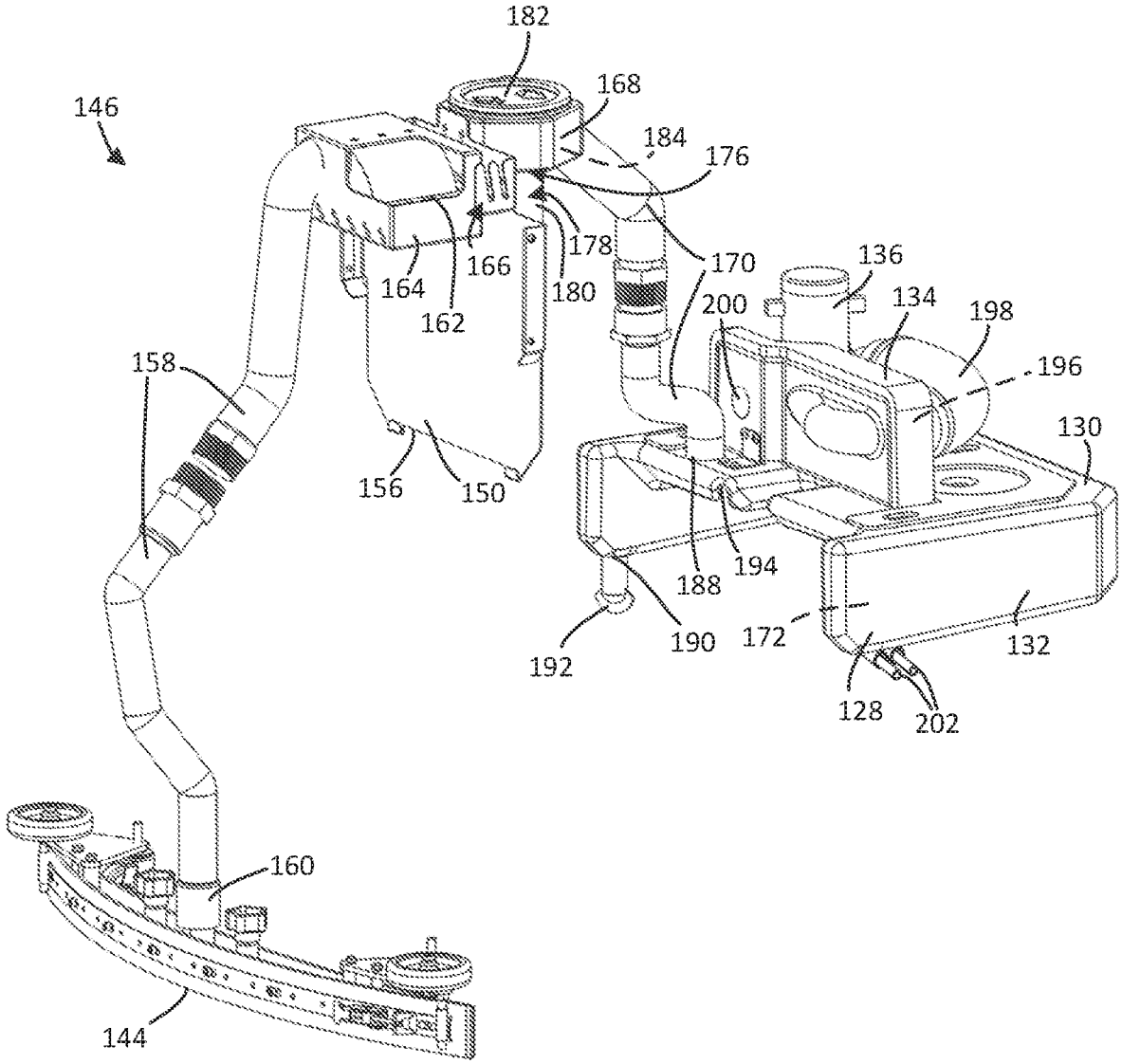
Figure 4D:
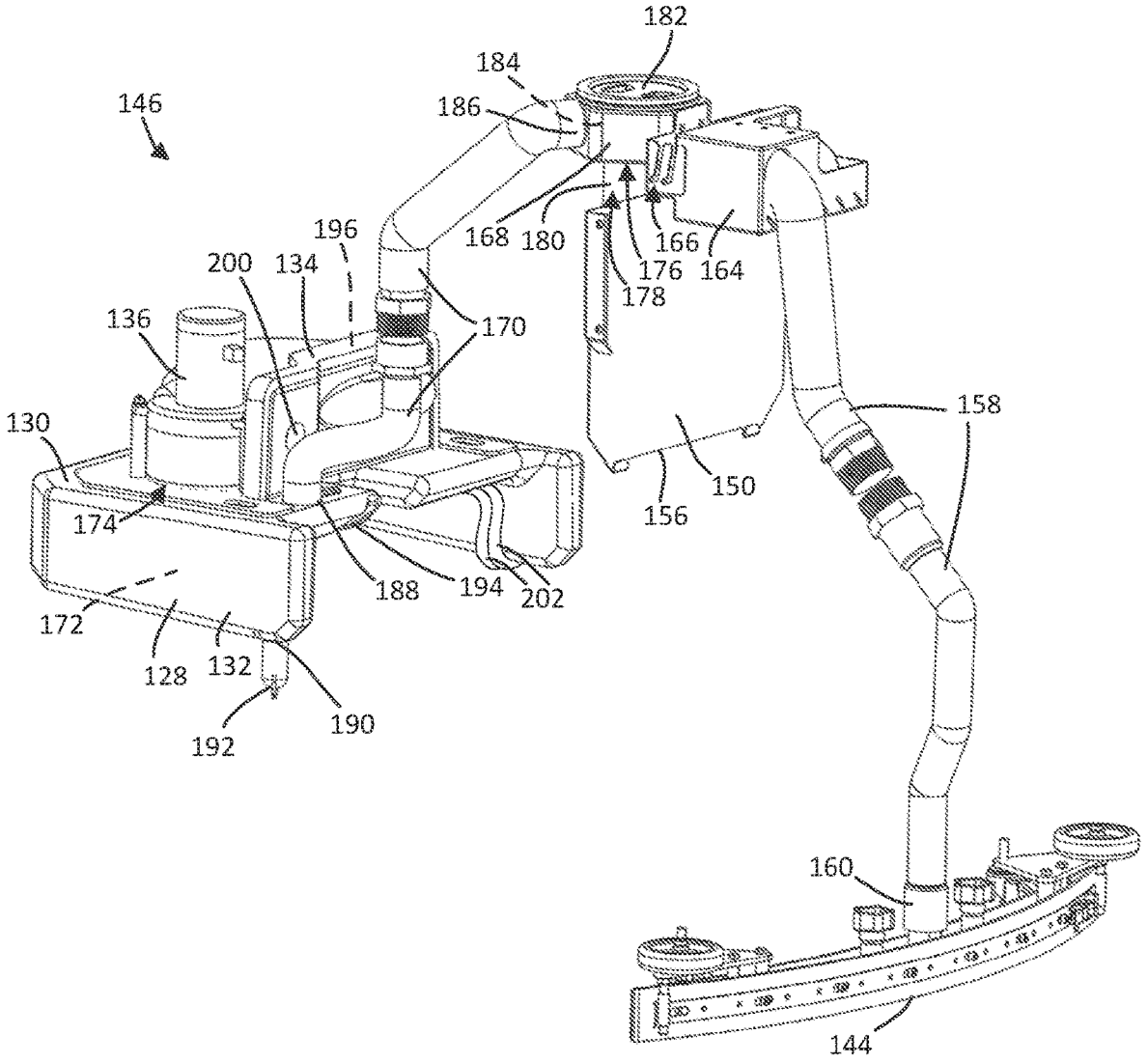

Above the access panels 122 is a bandeau cover or skirt 128 which, in the form illustrated, is moveable with the liftable tank 120. Traditionally, this skirt 128 would cover some of the structural support items of the chassis 116 and provide a desired aesthetic for the exterior housing in combination with the access panels 122 and the liftable tank 120. With further reference to FIG. 3 in which the access panels 122 are omitted and the tank 120 is sectioned, it can be seen that in the illustrated embodiment, the skirt 128 includes a horizontal platform 130 having a set of side walls 132 extending downwardly therefrom on the front and lateral sides and further includes a rear panel 134 extending upwardly from the horizontal platform 130. A vacuum source or pump 136 is supported on the top surface of the horizontal platform 130.

It should be briefly noted that this structure can reduce the noise produced by the machine during operation, as the vacuum pump 136 is substantially surrounded by walls of various kinds. With this placement of the vacuum pump 136 on the horizontal platform 130 of the skirt 128, with the pump 136 being placed between the liftable tank 120 and the skirt 128, and with the further placement of a rear panel 134 (which may also be called a muffler box) of the skirt 128 behind the vacuum pump 136, the sound of the vacuum pump 136 during operation can be deadened, which significantly reduces the noise during the operation of the pump 136.

Further, it should be briefly noted that the skirt 128 is significantly different than traditional skirts in that the skirt 128 forms a part of the vacuum pathway and provides a collection point prior to the pump 136 for certain liquids or small debris (effectively, non-gases) that have travelled up the vacuum pathway towards the pump 136 as well as a mechanism for dumping such non-gas materials from the skirt 128. Additional description of the novel structures and features of the skirt will be separately described in greater detail below.

Returning now to the general structure of the machine 100 and as best illustrated in FIG. 3, the liftable tank 120 provides two storage volumes. The first volume is a recovery chamber 138 formed in a top side of the liftable tank 120. A removable airtight cover 140, illustrated in FIGS. 1 and 2, is placed over the recovery chamber 138 to define an inner volume of the recovery chamber 138 and, when the cover 140 is lifted, provides access to the inner volume of the recovery chamber 138. The recovery chamber 138 serves as a tank for holding the recovered cleaning fluid, foam, and debris after it has been used to clean the floor. As will be described in greater detail below, this fluid, foam, and debris is recovered using a vacuum system (which is mostly shown isolated from the rest of the machine in FIGS. 4A through 4D). The second volume provided by the liftable tank 120 is a clean fluid tank 142 which is the source of the fluid to be applied to the floor. The clean fluid tank 142 is actually provided by the interior walls of the liftable tank 120 as best illustrated in FIG. 3 (i.e., the clean fluid tank 142 is found in the space between the walls). Thus, the liftable tank 120 includes both the clean fluid tank 142 and the recovery chamber 138, although the clean fluid tank 142 and the recovery chamber 138 are not in direct fluid communication with one another by any structure of the liftable tank 120. It is contemplated that in some systems different from the illustrated system, the fluid in the recovery chamber may be recycled (e.g., filtered and returned to the clean fluid tank for subsequent cleaning usage). However, in the illustrated system, when the recovery chamber 138 is full the dirty water is simply dumped or drained.

While the recovery chamber 138 and the clean water tank 142 are shown as being formed in part of the liftable tank 120, it is contemplated that in some forms the recovery chamber 138 and/or the clean water tank 142 could be separately formed and/or placed in an alternate location on the floor scrubber 110. Thus, as with all structures described and illustrated in this application, the illustrated structure is exemplary but not limiting.

The floor scrubber 110 additionally includes a number of other parts. A drain hose (not illustrated in the views taken) may be connected to the side of the floor scrubber 110 and can be opened and/or lowered to drain the recovery chamber 138. A squeegee 144 extends across the lower portion of the rear end 114 of the floor scrubber 110 to contain and recover any cleaning fluid applied to the floor which is then stored in the recovery chamber 138 until this recovered fluid is drained. An open end of the vacuum system may be mounted to or positioned proximate to the squeegee 144 to collect excess fluid as will be described in greater detail now with respect to FIG. 3 and FIGS. 4A through 4B.

Turning now to FIG. 3 and FIGS. 4A through 4D, an improved fluid collection system 146 for the floor maintenance machine 110 is illustrated. FIG. 3 illustrates the components of the improved fluid collection system 146 with most of the floor cleaning machine 110 surrounding these components, while FIGS. 4A through 4D illustrate various portions of the improved fluid collection system 146 apart from the machine 110 to better illustrate the vacuum pathway isolated from the remainder of the machine 110.

The central part of this fluid collection system 146 is the recovery chamber 138, best shown in FIG. 3 (and not specifically illustrated in FIGS. 4A through 4D), which defines a volume 148 along with the top lid or cover 140. A lower portion of the volume 148 of the recovery chamber 138 is configured to receive and store the recovered clean fluid, foam, and debris (as noted above), while the remaining upper portion of the volume 148 is configured occupied by a gas such as air.

A centrally-disposed and vertically-extending baffle 150 separates the volume 148 of the recovery chamber 138 into multiple sections by running from one lateral wall of the recovery chamber 138 to the other and extending upward from the lower wall of the recovery chamber 138. In the particular recovery chamber 138 shown, the baffle 150 separates or bifurcates the volume 148 of the recovery chamber 138 into a first, rearward "foamy" section 152 (because the foam portion of the collected fluid is primarily to be retained in this section of the volume) and a second, forward "non-foamy" section 154 (which has much less foam—and preferably no foam—due to the blocking action of the baffle 150). It should be appreciated that "non-foamy" and "foamy" are relative terms used to describe the quality of the recovered material that will be stored in each section and that, the cleanliness of the recovered liquid and the concentration of debris in the recovered liquid will likely be roughly equal on both sides of the baffle 150. These two sections 152 and 154 also placed into fluid communication with one another by at least a connecting passage 156 which, in the form illustrated, is found at the lower end of the baffle 150 between the baffle 150 and the lower wall of the recovery chamber 138. The connecting passage 156 is exemplary only and may be replaced with or used in addition to other connecting passages at the periphery between the baffle 150 and the walls of the recovery chamber 138 and/or additional connecting passages between the two sides extending centrally through the wall of the baffle 150.

Now with additional specific reference to FIGS. 4A through 4D, the structure of vacuum pathway before and after the recovery chamber 138 is illustrated separate from the machine 110. Various features and elements of this vacuum pathway can also be seen in FIG. 3; however, the isolation helps to highlight these features and the pathway.

First, the rearward portion of the vacuum pathway of the fluid collection system 146 from the squeegee 144 to the recovery chamber 138 will be described. To inform the structural description that follows, it is generally noted that the recovery chamber 138 will be below atmospheric pressure (i.e., under vacuum) during use and so the portion of the vacuum pathway from the squeegee 144 to the recovery chamber 138 is utilized to draw used liquid, debris, and gas from the area of the squeegee 144 into the recovery chamber 138. The gas from the recovery chamber 138 will be further drawn into the forward portion of the vacuum pathway from the recovery chamber 138 to the vacuum pump 136. This pumped gas recreates the vacuum that generates the suction force for operation of the fluid collection system 146. While gas is primarily drawn into this forward portion, as noted above, some amount of fluid or debris may also enter this segment of the vacuum pathway.

Look specifically at the structure of the rearward portion of the vacuum pathway, an intake hose 158 extends from a lower opening 160 at the squeegee 144 to an upper opening 162 received over a collection tray 164 mounted on the baffle 150 on the rearward "foamy" section 152 of recovery chamber 138. In the particular form illustrated, the lower opening 160 of the intake hose 158 is coupled to the assembly of the squeegee 144 or is placed immediately next to the squeegee 144 to collect the used liquid (which may have some amount of debris) directed by the squeegee 144 toward the lower opening 160 as the machine 110 is moved forward during operation. The openings 160 and 162 of the intake hose 158 are in fluid communication with one another such that the material sucked from the squeegee 144 into the lower opening 160 of the intake hose 158 is deposited into the collection tray 164 in the recovery chamber 138 by the downward facing upper opening of the intake hose 158. In the particular form illustrated, the collection tray 164 is removably mounted to the rearwardly-facing side of the baffle 150 at a pair of bent rearwardly-facing walls using a pair of angled slot and post connections 166. The collection tray 164 has a set of openings or slots on the bottom side and/or sidewalls thereof such that when liquid and debris are drawn into the recovery chamber 138 at the upper opening 162 of the intake hose 158, the liquid and debris must first enter the collection tray 164 which acts as an initial and rough filtering mechanism, before the liquid and debris might enter the liquid collected in the rearward "foamy" section 152 of the recovery chamber 138. In this way, large objects such as sticks, garbage, and so forth are captured in the collection tray 164 for removal while the liquid and small debris capable of passing through the filtration openings in the collection tray 164 may enter the liquid in the recovery chamber 138. This collection tray may be periodically removed and its contents dumped as part of routine operation and maintenance.

It is noted that, as illustrated, the intake hose 158 is broken into two sections which are connected on different sides of the liftable tank 120. That is to say, one segment is connected on the outside of the liftable tank 120, another segment is connected to the inside of the recovery chamber 138, and the segments are joined to one another to place them in fluid communication with one another by a fitting or opening extending through the clean water tank 142 of the liftable tank 120). However, in other forms, the intake hose may be a single continuous hose or may have more than two segments. The purpose of the intake hose 158 is primarily to create a channel between an external fluid/debris collection point and the recovery chamber 138 and various structures might be implemented to provide this fluid connectivity.

Now the forward section of the vacuum pathway will be described in greater detail. While the aforementioned rearward section places the lower opening 160 of the intake hose 158 in fluid communication with the rearward "foamy" section 152 of recovery chamber 138, the forward section places the vacuum pump 136 in fluid communication with the forward "non-foamy" section 154 of the recovery chamber 138. Notably, and in contrast to traditional fluid collection systems, the forward section of the vacuum pathway includes a segment that extends through the skirt 128 to act as a pre-vacuum collection point for moisture and debris.

Looking now more specifically at the forward section of the vacuum pathway, the pathway extends from a hollow filter box 168 (which is in gaseous communication with the recovery chamber 138) to the vacuum pump 136. To link the hollow filter box 168 to the vacuum pump 136, a vacuum hose 170 connects the hollow filter box 168 to a hollow interior volume 172 of the skirt 128 which, in turn, is coupled to an intake port 174 of the vacuum pump 136.

With respect to the hollow filter box 168, the hollow filter box 168 is supported by the forward facing surface of the baffle 150. The hollow filter box 168 provides an upper intake 176 on a bottom side thereof for the forward section of the vacuum pathway. The upper intake 176 is notably on a different side of the baffle 150 than the upper opening 162 of the intake hose 158. As such, the baffle 150 may provide a physical barrier for that inhibits certain contents (e.g., primarily foam) that are collected in rearward "foamy" section 152 of the recovery chamber 138 from migrating to the forward "non-foamy" section 154 of the recovery chamber 138 which includes the upper intake 176 used to draw the vacuum in the recovery chamber 138 so those contents.

To prevent the entry of liquid into the upper intake 176 and into forward section of the vacuum pathway, the upper intake 176 may have a floating ball valve mechanism 178 dropped into the box 168 from above. The floating ball valve mechanism 178 includes a vertically-extending column 180 made of a screen or mesh material with a ball (not illustrated) received therein and the ball is movable vertically in the vertically-extending column 178. The ball is configured to buoyantly float on the liquid received and stored in the recovery chamber 138 and to ascend the vertically-extending column 180 as the liquid level in the recovery chamber 138 rises. When the ball is raised within the column 180 toward the upper intake 176 as the result of being lifted by the collected liquid, the ball forms a seal around a gasket at the top of the vertically-extending column 180 and, thus closes the upper intake 176 on the bottom side of the box 168 to inhibit passage of the liquid from the recovery chamber 138 into the forward section of the vacuum pathway. In this way, if the fluid level gets too high, fluid will not get sucked into forward section of the vacuum pathway and the vacuum for cleaning the floor is effectively shut off or blocked. Moreover, the mesh of the screen can prevent debris that may have migrated to the forward "non-foamy" section 154 of the recovery chamber 138 from being pulled into the intake 176 under vacuum.

The vertically-extending column 180 may have a radially-extending flange on a top axial end thereof that permits the floating ball valve mechanism 178 to be dropped in the circular opening when an upper cover 182 of the box 168 is removed. This provides an easy way to insert and remove the vertically-extending column 180, which historically may have required the use of upward fasteners or other upward attachment connection schemes in order to assemble the column into the recovery chamber. Note that, the use of these old fasteners or upward connection schemes to install this column could be awkward to install and/or labor intensive. In the absence of such fasteners, older designs may also have employed a snap-in configuration in which the column would be upwardly snapped in; however, in this snap-on configuration, the column might snap off and fall off into the liquid, thereby leaving the intake opening to the vacuum unprotected. This new drop-in design, in which the upper flange of the vertically-extending column 180 walls of the box 168 as it is dropped in, makes it easy to install or remove the floating ball valve mechanism 178 without tools and prevents any possibility that the column 180 could be detached and fall into the recovery chamber 132.

At an upper end of the vertically-extending column 180 and at the upper intake 176, there may also be a filter 184 that is interposed between the gaseous volume of the recovery chamber 138 and the vacuum line 170 that is inserted after the column 180 is dropped in. This filter 184, in addition to the mesh of the vertically-extending column 180, can capture debris, and particularly airborne particulates, passing through the filter 184. With the filter in the box 168, the upper cover or lid 182 can then be placed over the filter 184 and attached to the box 168 to slightly depress the filter 184 against the top side of the vertically-extending column 180. In some preferred forms, this cover 182 is transparent so that the filter 184 may be visually seen without removing the cover 182, so that a user may establish when the filter 184 needs replacing. This filter 184 may be viewable once the tank cover 140 is lifted or, if the cover 140 is also transparent or is provided with a viewing port, may even be viewable with the cover 140 closed so the operator can see the filter 184 from the normal operating position through the cover 140 and lid 182. Traditional opaque covers required the user to manually remove a cover in order to make that assessment.

The hollow box 168 is connected to the vacuum hose 170 at a box connection port 186 and the hose 170 is connected to the skirt 128 at a skirt connection port 188. As noted above with respect to hose 158, the hose 170 has two segments in the illustrated embodiment, but in alternative forms have one, two, or more segments.

Turning now to the skirt 128, it should be appreciated that the skirt 128 represents a new and non-traditional additional intermediate segment of the vacuum pathway. Most notably, the skirt 128 now contains the hollow interior volume 172 which places the skirt connection port 188 in fluid communication with the intake port 174 of the vacuum pump 136. This means that anything entering the vacuum pump 136 from the recovery chamber 138 must necessarily pass through the hollow interior volume 172 of the skirt 128, at least according to the illustrated embodiment). Conventionally, skirts were not part of the vacuum pathway.

By virtue of various structures present in the skirt 128, the there are several benefits of this additional, intermediate segment which are lacking in conventional designs in which the vacuum hose 170 is directly connected to the vacuum pump 136.

Among other things, the segment of the pathway through the skirt 128 permits an additional collection point for liquid, foam, and debris before such matter could reach the vacuum source 136. Although such matter ideally would not have made it this deep into the vacuum pathway, in practice some amount of moisture and debris will migrate to this position. The skirt 128 can be designed such that a lower edge of the side wall 132 that extends downwardly from around a section of the periphery of the horizontal platform 130. Both the horizontal platform 130 and the lower edge of the side walls 132 can have respective drafts that slant downward to a low point 190 on the lower edge of the side wall 132. These drafts may be, for example, approximately 2 degrees. Proximate this low point 190 there can be a valve 192 such as a duckbill valve as illustrated. This duckbill valve 192 selectively places the internal chamber 172 of the skirt 128 in fluid communication with a surrounding environment to clear fluid or debris from the internal chamber 172 of the skirt 128. When the interior chamber 172 of the skirt 128 is below a threshold pressure (due to, for example, the running of the vacuum pump 136 or the vacuum source), the valve 192 is held closed to maintain vacuum. However, when the threshold pressure is met (due to lack of vacuum being drawn and/or due to the amount of collected fluid in the internal chamber 172), the valve 192 is permitted to open to accommodate the release of any liquid that has collected in the interior chamber 172 of the skirt 128 from the interior chamber 172 of the skirt 128. Advantageously, the released liquid can be subsequently collected by the squeegee 144 and be drawn up back up into the recovery chamber 138. Further, this released liquid can be dispensed by the valve 192 at a location visible by the operator. By seeing this released liquid on the floor, the operator can be made aware that there is potentially something in the vacuum pathway that needs examination, servicing, or replacement.

To further assist in preventing liquid or foam in the skirt 128 from entering the vacuum pump 136, there may be a rib 194 formed in the horizontal platform 130 of the skirt 128. This rib 194 can be shaped and positioned such that in order for any fluid to go through the internal chamber 172 of the skirt 128 from the skirt connection port 188 of the skirt 128 to the intake port 174 of the skirt 128, the fluid would have to pass around this rib 194 which also directs the fluid into the hollow space of the side walls 132. Once in the side walls 132, any liquid phase that has reached this portion of the vacuum pathway would likely drop within the side walls 132 for collection at the low point 192 due to gravity and be less prone to be sucked into the vacuum pump 136. Meanwhile, gas could flow back up and into the vacuum pump 136 through the vacuum pump connection port 174.

It is further noted that exhaust gas from the vacuum pump 136 can be directed through the rear panel 134 that was described earlier. This gas may be directed into a hollow volume 196 of the panel 134 (which is separate from the hollow volume 172) by a connecting tube 198 and the gas ejected through horizontally extending opening 200. To the extent that any liquid phase is present in the exhaust gas, this liquid phase may again settle on a lower surface of the hollow volume 196 of the rear panel 134 and be drained downward using drainage tubes 202, which extend out below the skirt so that an operator can see the expelled fluid. In this way, gas containing a liquid phase is not exhausted into the interior compartments of the machine, since moisture could potentially damage or expedite degradation of various internal system components.

It is contemplated the hollow portion the skirt might be replaced by another pre-existing structure in the machine which is made hollow to accommodate an extension of the gaseous pathway of the vacuum. Thus, while a skirt is shown and described as being a new part of the system, it is contemplated that other non-skirt elements might be modified in a similar way to be made hollow and to be included as part of the vacuum pathway. As one example, the baffle might be made hollow and become part of the vacuum pathway.

So to summarize, an improved fluid collection system 146 for a floor cleaning machine 100 can be used to collect fluid, foam, and debris in a way that prevents these materials from getting sucked upstream to the vacuum pump 136. During typical operation the machine 110 is turned on, and fluid is dispensed from machine 110 to the floor from the clean water tank 142 and the vacuum pump 136 is activated. The scrubbers or brushes 123 work the dispensed water/cleaning fluid at the floor surface. As the machine 110 moves forward, the used fluid gets directed by the squeegee 144 to the lower opening 160 of the intake hose 158. Under the vacuum generated by the vacuum pump 136, the fluid, foam, and debris at the lower opening 160 is drawn into the recovery tank 138 by the intake hose 158. At the upper opening 162, the fluid, foam, and debris is initially passed through the collection tray 164, which acts as a rough filter and the remainder is collected in the rearward "foamy" section 152. The baffle 150 permits the fluid and some small amount of debris to pass to prevent the forward "non-foamy" section 154. Primarily gas (but possibly some moisture, foam, or small debris) is drawn into the upper intake 176 of the hollow filter box 168. The mesh of the screen on the vertically extending column 180 and the filter 184 may provide another finer filter at this stage. The gas (and small portion of moisture, foam, or debris) is drawn through the vacuum hose 170 into the hollow volume 172 of the skirt 128. In the skirt 128, the liquid, foam, or debris portions of the fluid stream may be directed into the side walls 132 where, under gravity they collect at low points to provide one final stage of separation before the fluid stream (ideally now primarily gas) is drawn into the vacuum pump 136 via the intake port 174. The vacuum pump 136 exhausts gas through a hollow space 196 of a rear wall 134 of the skirt 128 to direct any exhaust or moisture away from operational parts. Eventually, when the machine 110 is turned off, the vacuum pump 136 is shut off, the vacuum is broken in the fluid collection system 146, and a valve 192 is permitted to open to cause any collected fluid, foam, or debris in the skirt 128 to be evacuated from the hollow volume 172 of the skirt 128 and be dispensed to the floor (where the squeegee 144 may collect it when the machine 110 is again operated).

Thus, an improved fluid collection system for a floor maintenance machine is disclosed. By incorporating one or more hollow bodies, the skirt and/or other structural may be added to the vacuum pathway to reduce the likelihood of fluid, foam, or debris passing to the vacuum source. Indeed, since the skirt (or other pre-existing structure made hollow) already exist, these improvements by making the bodies hollow permit these items to perform a function that is clearly apart from and in addition to to their primary functions. Further still, by making the filter at the upper intake visible, it can be more readily determined when the filter needs replacement to improve the quality with which a vacuum is drawn. Yet another contemplated improvement is that the rear wall of the skirt provides a sound barrier for the vacuum pump to reduce the volume of the operation of the machine and to provide a passageway for the directed exhaust of gas.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A fluid collection system for a floor maintenance machine, the fluid collection system comprising: a recovery chamber defining a volume; a hollow structure including a horizontal platform and a side wall extending downwardly from the horizontal platform and the hollow structure having an internal chamber that extends downwardly to a low point, in which the horizontal platform and the sidewall define a top and at least one side of an open space that at least partially receives components of floor cleaning implements; a valve attached to the hollow structure at the low point of the internal chamber; a vacuum source in fluid communication with the volume of the recovery chamber via the internal chamber and a vacuum line, in which the vacuum source is located on top of the hollow structure; and a rear wall extending upwardly from the horizontal platform, the rear wall being hollow to provide a pathway from an exhaust port of the vacuum source to an opening at the rear wall to direct exhaust away from operational components; wherein the vacuum source draws a vacuum in the volume of the recovery chamber by drawing a gas from the volume of the recovery chamber through the internal chamber and through the vacuum line and wherein the valve is configured to selectively place the internal chamber of the hollow structure in fluid communication with a surrounding environment such that, when the internal chamber is below a threshold pressure, the valve is held closed and, when the threshold pressure is exceeded, the valve is permitted to open to accommodate release of any liquid that has collected in the internal chamber from the internal chamber.

2. The fluid collection system of claim 1, wherein the vacuum source draws the vacuum in the volume of the recovery chamber by drawing the gas from the recovery chamber sequentially through an intake of a hollow filter box, through the vacuum line, and through the internal chamber of the hollow structure to the vacuum source.

3. The fluid collection system of claim 1, wherein the valve is a duck bill valve.

4. The fluid collection system of claim 1, further comprising a connection port on the hollow structure connected to the vacuum line and an intake port connected to the vacuum source.

5. The fluid collection system of claim 4, wherein the connection port and the intake port are both positioned on the horizontal platform and a rib is formed in the horizontal platform that separates the connection port from the intake port.

6. The fluid collection system of claim 5, wherein a presence of the rib on the horizontal platform requires any fluid drawn from the connection port to the intake port to flow from the horizontal platform and into the side walls.

7. The fluid collection system of claim 1, wherein the rear wall defines one surface of a volume in which the vacuum source is received to contain a noise emitted from the vacuum source.

8. The fluid collection system of claim 1, further comprising a hollow filter box.

9. The fluid collection system of claim 8, wherein the hollow filter box provides an upper intake having a floating ball valve mechanism received therein, the floating ball valve mechanism comprising a vertically-extending column with a ball received therein and which is movable vertically therein, the ball being configured to float on a liquid received and stored in the recovery chamber to ascend the vertically-extending column and wherein, when the ball is raised within the column, the ball seals the upper intake to inhibit passage of the liquid from the recovery chamber into the hollow structure.

10. The fluid collection system of claim 8, further comprising a filter in the hollow filter box that is interposed between the volume of the recovery chamber and an upper intake and wherein the filter is viewable from a top side through a transparent cover.

11. The fluid collection system of claim 1, further comprising an intake hose including an opening that places the intake hose in fluid communication with the volume of the recovery chamber, the intake hose being configured to draw used fluid from the floor into the recovery chamber when the vacuum is drawn in the recovery chamber.

12. A floor maintenance machine comprising the fluid collection system of claim 1.

13. The fluid collection system of claim 1, wherein, relative to a horizontal direction, a lower wall of the horizontal platform has a first draft and a lower edge of the side wall has a second draft both extending toward the low point.

14. The fluid collection system of claim 1, wherein the rear wall that is hollow further includes drainage tubes extending therefrom for downward drainage of liquid collecting in a hollow volume of the rear wall.

15. The fluid collection system of claim 14, wherein the drainage tubes have an outlet that extends out below the hollow structure.

16. The fluid collection system of claim 14, wherein the hollow volume of the rear wall is separate from the hollow structure.

* * * * *